United States Patent [19]

Hawkins

[11] Patent Number: 4,614,251

[45] Date of Patent: Sep. 30, 1986

[54] LOAD RAISING VEHICLE AND METHOD

[75] Inventor: Hugh M. Hawkins, Annandale, Va.

[73] Assignees: John J. Kirlin, Rockville; Wayne T. Day, Wheaton, both of Md.

[21] Appl. No.: 645,361

[22] Filed: Aug. 29, 1984

Related U.S. Application Data

[62] Division of Ser. No. 260,761, May 5, 1981, Pat. No. 4,491,449.

[51] Int. Cl.[4] ..... E04G 1/22

[52] U.S. Cl. ..... 182/63; 182/141

[58] Field of Search ..... 414/10, 11, 12; 182/63, 182/117, 141, 142, 150; 254/9 C

[56] References Cited

U.S. PATENT DOCUMENTS

| | | | |
|---|---|---|---|
| 1,638,611 | 8/1927 | Baldwin | 182/141 |
| 2,370,887 | 3/1945 | Soskin | 182/141 X |
| 3,341,042 | 9/1967 | Carder | 414/471 |
| 3,537,546 | 11/1970 | Klosk | 182/141 X |
| 4,234,055 | 11/1980 | Beeche | 182/142 X |

*Primary Examiner*—Leslie J. Paperner

*Assistant Examiner*—Janice Krizek

*Attorney, Agent, or Firm*—Larson & Taylor

[57] ABSTRACT

A vehicle and method for raising elongated objects, especially for raising pipes and the like to a ceiling structure in the construction of a building. The vehicle has a pair of transversely extending support stands and a lift such as a scissors lift adjacent each. On top of each lift is a saddle for supporting an object to be raised and a transversely extendable rod with a hook end. A platform may be removably attached to each lift. In the method of operation of the invention to lift an elongated pipe, the rod and the lifts are utilized to engage a pipe in a stockpile and lift the same onto the support stands. Thereafter the lifts are lowered, the elongated pipe is rolled to be over the saddles of the lifts, and the lifts are raised to raise the pipe up to its desired position in the ceiling structure. Other applications of the vehicle and method include raising a very large work platform up to the ceiling structure to be secured thereat, raising a platform having work pieces prearranged thereon in a predetermined order, and supporting a scaffolding for working on the side of a building or the like.

4 Claims, 19 Drawing Figures

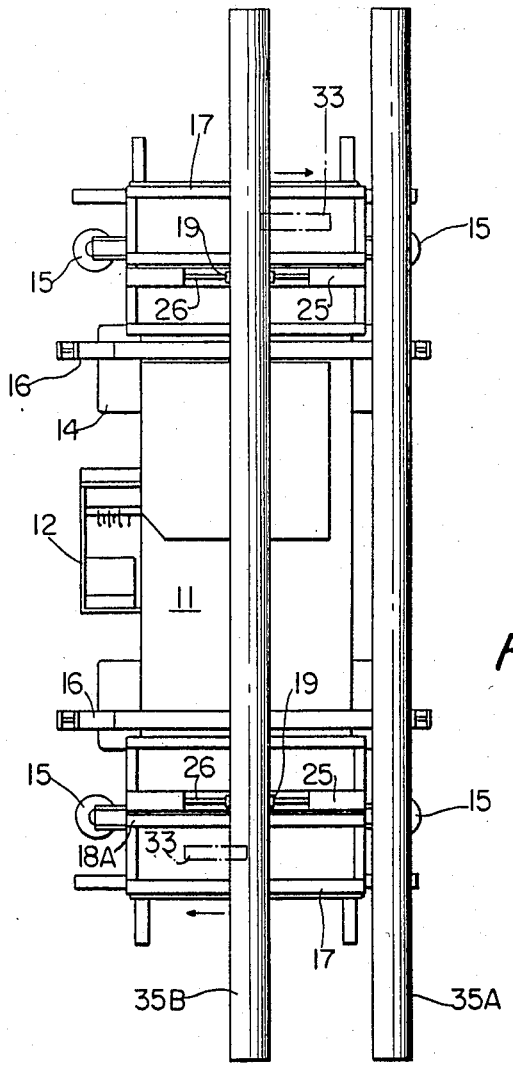
FIG. 11
FIG. 12
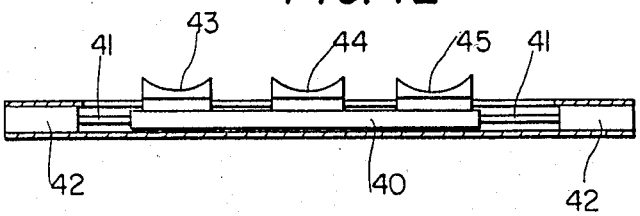
FIG. 13
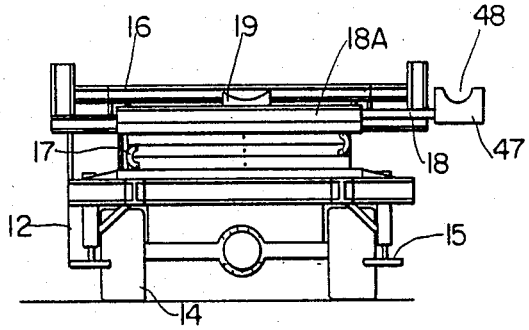
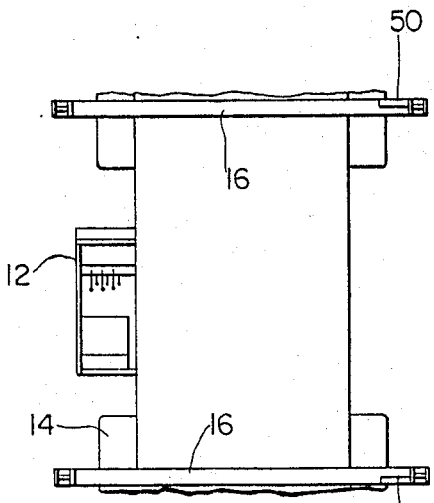
FIG. 14
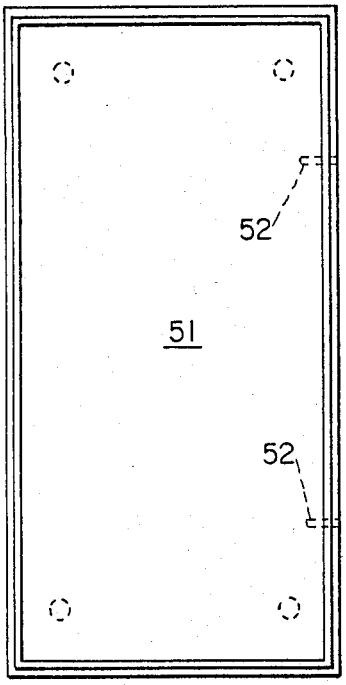

LOAD RAISING VEHICLE AND METHOD

This is a division of application Ser. No. 260,761 filed May 5, 1981, now U.S. Pat. No. 4,491,449.

TECHNICAL FIELD

This invention relates to the lifting of elongated objects, and in particular it relates to a new and improved method and vehicle for transporting such objects from ground level up to a ceiling height, such as in the construction of buildings or the like.

In the construction of certain buildings, one essential process is the positioning of pipes, ducts and the like at a raised height such as in the ceiling. After the building has been constructed to the point that it includes columns and at least one horizontal level spaced above the ground level, it becomes necessary to install networks of pipes of all different sizes, sheet metal ducting, wires and the like on the underside of this horizontal level for air conditioning, heating, plumbing, electrical circuitry and the like. This process currently involves many man hours of difficult work and/or highly inefficient use of very expensive machinery.

For example, workmen must initially install on the ceiling structure the beams, hanger rods and the like which will support the pipes, conduits and the like. The choice is either to work on ladders or to utilize a hydraulic lift having a platform on the top. Considering that such equipment might cost approximately $21,000 apiece, it represents a highly inefficient use of such expensive equipment for one crew to tie up this expensive piece of equipment for long periods of time.

After the supporting structure has been installed in the ceiling structure, there comes the task of raising the pipes up to the ceiling. The current practice is to use a system of chains and pulleys, passing the chains over openings in the ceiling structure, and pulling these pipes up in place, usually to a height of approximately 14'. While this task is not too difficult for small diameter pipes of 2" to 3", it is a major operation in the case of very large pipes, for example 10" in diameter. Such pipes, taken in 20' lengths, weigh approximately 800 to 900 pounds each. In a normal workday, a normal crew could be expected to lift approximately four such pipes, i.e. a work output of 80 linear feet per day. Moreover, a weld must be performed where each of the 20' segments come together, and it represents approximately one-half of one man's workday to complete such a weld. In the context of a very large building such as a shopping mall or the like, it will be appreciated that the area of the ceiling structure requiring such conduits, pipes or the like would be extremely large, i.e. larger than many football fields, and that the amount of man-hours required to complete the placing of all such pipes and conduits for all of the different utilities involves a tremendous number of man-hours. The problem of course remains true, although to a somewhat lesser extent, for smaller structures.

While the problems are particularly acute with respect to very heavy pipes, similar problems exist with respect to raising all kinds of conduits, equipment and the like up for installation in a ceiling structure. For example, with respect to sheet metal ducting, while the individual pieces are not as heavy, there still remains the task of getting the pieces up to the ceiling and maintaining the workmen at the ceiling level to complete the welding operations. Similarly, with respect to other kinds of equipment such as electrical equipment and wiring and fire protection sprinkler systems, there remains the task of getting the equipment to the ceiling and keeping workmen at the ceiling long enough to perform the necessary installations. Another problem associated with building construction concerns arranging scaffolding on the side of a building to perform operations on that side such as painting, installing siding, installing glass, etc. Present practice is to either hang a scaffolding from the roof, which scaffolding has a disadvantage of only a single platform, thus permitting workmen to work at one level only, or erecting a stationary scaffolding which has the disadvantage that it is time consuming to erect and disassemble.

There therefore exists a need for new and improved methods and apparatus for lifting elongated objects, especially in the context of constructing a building; and there also exists a need for improving the other above noted construction procedures.

SUMMARY OF THE INVENTION

It is a purpose of the present invention to provide a new and improved load raising vehicle and method which overcomes the problems of the prior art and provides new and important advantages.

The purpose of the present invention is carried out by providing a load raising vehicle and method having the capability of raising an elongated object off of the ground and placing it onto a support stand stationarily mounted on the vehicle by the use of a lifting means; and then, with the lifting means in its lowermost position and the elongated object positioned thereover, the lifting means is raised, engaging the elongated object and raising it to a substantially raised height such as the height of a ceiling structure in a building.

Another purpose of the present invention is to provide an arrangement and a method for raising relatively large platforms to ceiling height to be removed from the lifting apparatus and attached to the ceiling structure to remain there over a longer period of time as workmen carry out various operating procedures thereon. Such platforms may further include work pieces and the like placed in a predetermined arrangement thereon.

In accordance with a preferred embodiment of the present invention, there is provided a load raising vehicle having an elongated bed supported above a chassis and ground engaging structure such as a wheel structure or the like. On the bed there are provided support stands stationarily mounted on the bed and extending transversely thereacross. Associated with each support stand is a lifting device movable from a lowered position whereat the top of the lifting device is below the top of the support stand and a raised position substantially higher, i.e. approximately 20' above the support stand.

The lifting means preferably comprise scissor lifts having mounted to the tops thereof extendable hook rods and transversely adjustable saddle structures. The hook rods are extendable laterally so that at the stockpile of pipes or other objects, the pipes can be connected to the hook rods through suitable cables or the like, whereupon the lift can be raised to place the elongated object on the support stand. After an elongated object has been placed on the support stand and the lifts lowered to their lowermost position, the elongated object is moved to a position over the saddles and the lifts are raised such that the saddles engage the bottom of and support the elongated object during its ascent to the raised height.

In accordance with another feature of the present invention, platforms may be removably attached to the top of each lift for the use of workmen when working for long periods of time at the ceiling structure. Further, the platforms can be removed from the lift and attached to the ceiling structure so that the workmen can remain there for a long period of time and descend with a simple ladder, without requiring that the entire machine be tied up at that location for a long period of time.

In accordance with another application of the present invention, a very large platform, for example 7'×20' to 40', can be loaded on the support stands, once again using the lifts themselves to raise the large platform off of the ground and onto the support stands, after which the lifts can be lowered to a position under this large platform and then raised, taking the very large platform up to the ceiling, whereat it can be attached. This arrangement is particularly advantageous under certain circumstances such as at a specific location in the ceiling structure whereat an unusually heavy volume of welding work is required. Often such volume can require over a week's worth of man-hours at a single location. With the present arrangement, a simple, relatively inexpensive platform is then left attached to the ceiling structure in this area, access to and from which can be had by a simple ladder, thereby eliminating the need to leave a very expensive hydraulic lift structure (often costing approximately $21,000) in that specific location for a week or more.

In accordance with another advantageous feature of the present invention, subcontractors working on a building can at their own facilities prearrange pieces on a large work platform, which arrangement corresponds to the final arrangement of those pieces in the ceiling structure. The entire platform can then be conveyed to the building site and placed onto a vehicle of the present invention and lifted up to the ceiling structure, whereat the platform may or may not be attached to the ceiling structure. Hence, in contrast to previous procedures for installing conduits such as electrical conduits, sheet metal conduits, electrical and water sprinkler installations, whereat pieces were individually taken up to the ceiling, according to the present arrangement an entire section can be prearranged and brought directly up to the location of the ceiling in this prearranged form.

In accordance with another feature of the present invention, beams attached to the top of the lift can be utilized to support a scaffolding structure for workmen to work on the side of the building, as is the case when installing siding or glass or painting the side of a building. This eliminates the more time consuming task of manually arranging a scaffolding. Also, it is preferable in many respects to the type of scaffolding comprising a single platform which is lowered from the roof of a building.

Significant advantages of the present invention are illustrated by the results achieved in the raising of very large pipes such as 10" diameter pipes up to the ceiling. Heretofore, such pipes were generally raised in only 20' segments and a normal work crew could anticipate to raise only 4 such pipes for a total of 80 linear feet in an average work day. Further, a welding procedure for welding abutting pipes occurred every 20', and as noted above, it would take one half of a work day to complete a weldment around the circumference of two pipes abutting end to end. In contrast, utilizing the present invention, applicant found first of all that he could lift pipes 40 or more feet in length, thus immediately halving the number of required weldments and also saving on the cost of the pipes themselves since a longer pipe cost less per linear foot. More importantly, applicant found that with a similar three or four man work crew, instead of raising only 80' of 10" pipes in a work day, his crew could raise over 1000 linear feet of pipe in less than a full work day.

Hence, it is an object of this invention to provide a new and improved vehicle and method for raising elongated objects such as pipes and the like.

It is another object of this invention to provide a new and improved method and vehicle for raising pipes or the like from ground level to a raised location bordered by an upper horizontal level which precludes the use of an overhead crane.

It is another object of the present invention to provide a new and improved method and vehicle for raising elongated objects such as pipes or the like, comprising a support surface means and a lift means, and wherein the lift means serves the dual purpose of lifting the elongated object from ground level or the like up onto the support surface means and then to lift the elongated object from the support surface means up to the raised height substantially thereabove.

It is another object of this invention to provide a new and improved arrangement for providing a work platform, with or without work materials prearranged thereon, said platform being attachable to a ceiling structure.

It is another object of the present invention to provide a new and improved vehicle and method for lifting objects which can provide an improved scaffolding structure for working on the side of a structure.

These and other objects of the present invention will become more apparent from the detailed description to follow.

BRIEF DESCRIPTION OF THE DRAWINGS

There follows a detailed description of preferred embodiments of the invention to be taken together with the accompanying drawings wherein:

FIG. 11 is a plan view of the vehicle in FIG. 10 with a portion of the ceiling structure shown in phantom lines.

FIG. 12 is a partial view showing a modification of the present invention.

FIG. 13 is a rear elevational view illustrating a modification of the present invention.

FIG. 14 is a highly schematic plan view showing only the middle portion of the vehicle, next to a platform, to illustrate an operation which can be carried out with the present invention.

DETAILED DESCRIPTION OF THE PREFERRED EMBODIMENTS

Figure 1:
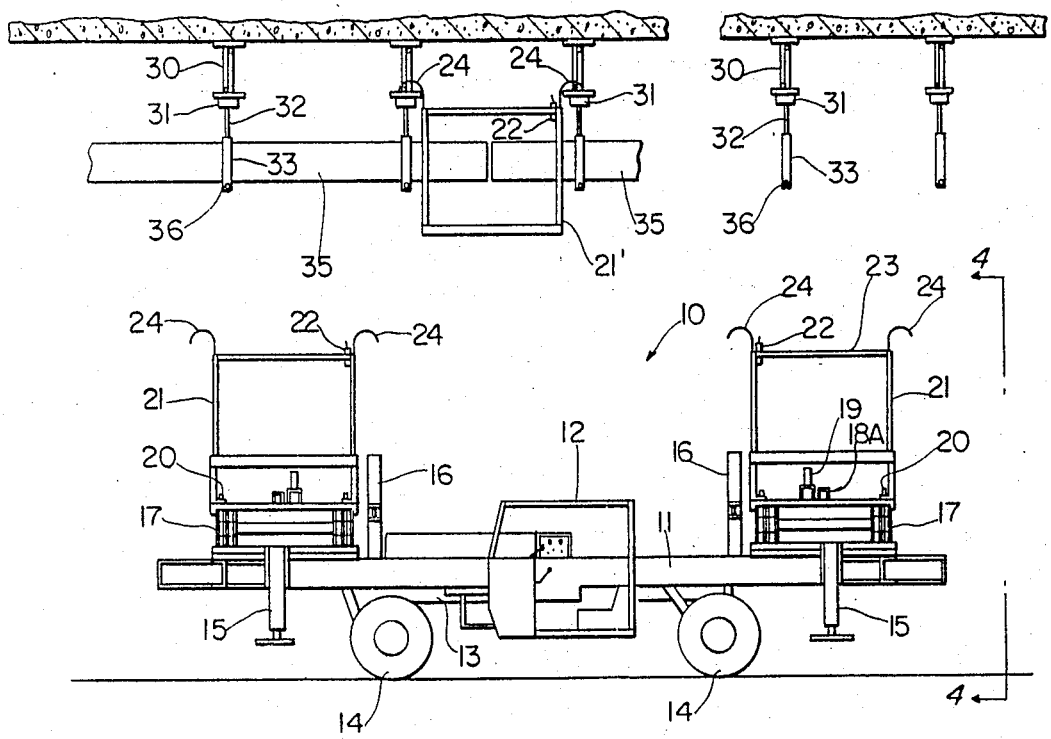
FIG. 1 is a side elevational view of a vehicle according to the present invention shown with the platforms mounted thereon and illustrating a portion of a ceiling structure thereabove.
Figure 2:
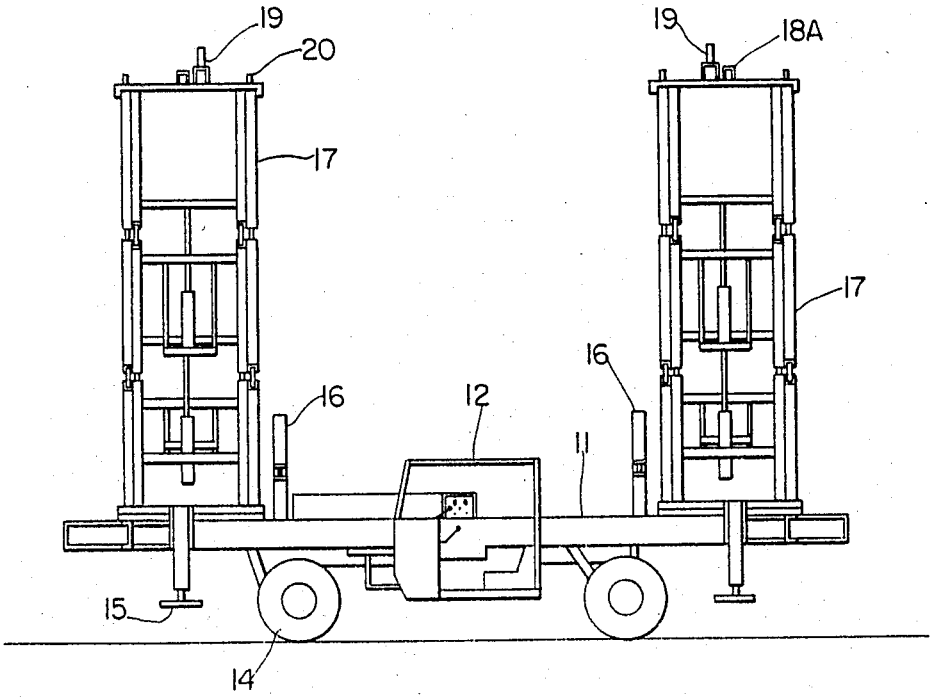
FIG. 2 is a side elevational view similar to FIG. 1 but omitting the ceiling structure, omitting the platforms and showing the lifts in the raised position.

Referring now to the drawings, like elements are represented by like numerals throughout the several views.

Referring to FIGS. 1 through 4, there is shown the load raising vehicle 10, while in FIG. 1 there is also shown a ceiling structure 30 representing the location at which the elongated objects originally located on the ground are to be positioned.

Figure 3:
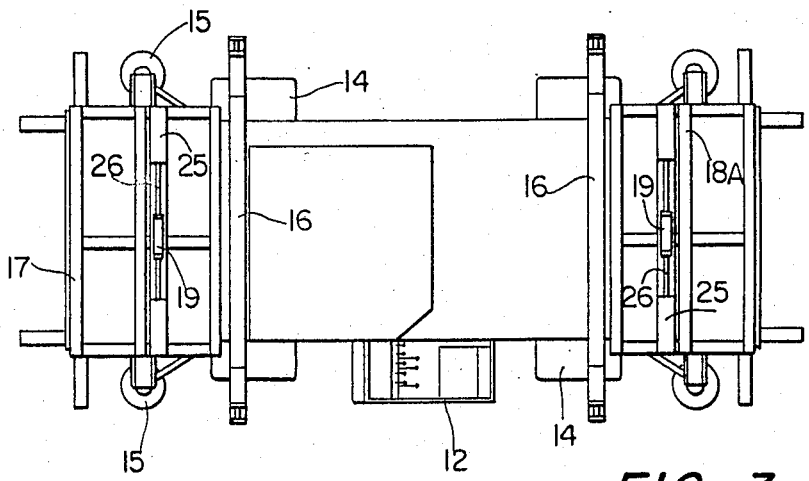
FIG. 3 is a plan view of FIG. 2.

The vehicle includes a base 11 stationarily mounted on the ground engaging structure which includes a chassis 13 which may be a conventional truck chassis, and wheels 14 which may be conventional truck tires but preferably conventional off-the-road tires having a greater ground engaging surface. As best illustrated in FIG. 3, the vehicle would be provided with hydraulically operated outriggers 15. Although the outriggers are of conventional design, they can perform a special function in connection with the present invention, as will be described in greater detail below.

Figure 4:
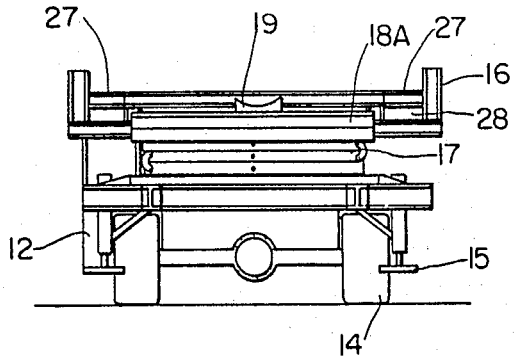
FIG. 4 is a rear elevational view of FIG. 1, but with the platforms removed.

Mounted on the base 11 are a pair of support stands 16 having elongated, transversely extending upper surfaces which form support surface means for the objects to be raised. Referring to FIG. 4, the upper surface of the support stands have end sections 27 which can be removed (i.e., either totally removed, telescoped out of position or hinged to the side) leaving a recessed bin 28 which may be suitable for carrying certain kinds of elongated loads under certain circumstances.

Adjacent each of the support stands 16, i.e. adjacent in the longitudinal direction of the vehicle, there is provided a lift means which in the preferred embodiment takes the form of a scissors lift 17. A scissors lift is preferred for its strength and ability to assume a very compacted lower position, as illustrated in FIGS. 1 and 4, as well as a substantially extended raised position, as shown for example in FIG. 2 (reference may also be had to FIG. 18 at this time for an illustration of a substantially raised position of the lift).

Two material handling devices are secured to the top of the upper section of the lifts 17, namely a hook rod 18 and a saddle structure 19. The hook rod 18 includes an outer tubular member 18A secured by welding or the like to the top of the lift 17 and having a rod 18 telescopically, slidably movable therein. The rod 18 has a hook at each end and can be moved outwardly as shown for example in FIGS. 5 and 6, for purposes to be described in greater detail below. Although the hook rod 18 can be operated manually, it can also be controlled by a power means such as a hydraulic means, and this would have additional advantages as will be described below.

The saddle 19 which is secured to the top of each lift 17 provides a means for positively engaging an elongated pipe or the like supported on the support stand 16 to stabilize the object during the step of raising the pipe. For purposes to be described below, the saddle 19 is preferably adjustable transversely. For this reason, it is connected to piston rods 26 associated with hydraulic cylinders 25.

As explained earlier, the primary advantage of the present vehicle is to raise elongated objects in the presence of an existing overhead structure which requires that the objects be raised from below and hence prevents their being lowered from above by a simple crane or the like. A typical environment would be a large overhead structure such as the ceiling structure in a building under construction. This ceiling structure is represented diagramatically by the element 30 in FIG. 1. It will be understood that in an existing working environment, this structure 30 could extend for hundreds of feet in both directions. Elongated objects such as pipes or the like are normally placed in groups of a few to a dozen pipes which can serve different purposes such as for heating, air conditioning, plumbing, electrical circuitry, etc. In the longitudinal direction, each of those conduits would be essentially continuous, meaning that they must be raised in segments and secured together after they are in place. The upper right hand side of FIG. 1 illustrates a ceiling structure 30 with a pair of needle beams 31 having been secured to the ceiling structure. Referring momentarily to the upper portion of FIG. 9, as well as said upper right hand portion of FIG. 1, these needle beams may extend across for a relatively short distance, i.e. 5 to 15', their function being to secure hanger rods 32 and pipe hangers 33 into which will ultimately be placed the pipes, followed by lower or bottom pipe support bolts 36 which are secured to the pipe hangers 33 and onto which the pipes rest. The upper left hand portion of FIG. 1 illustrates abutting end portions of two different pipes 35 which have already been secured in place. There remains the task of closing off the abutting ends by a circumferential welding process. It is of interest to note that this welding process, especially for a large pipe such as a 10" diameter pipe, is a very extensive and time consuming procedure. For example, it might require a half a work day just to complete this one weld.

A feature of the present invention is the provision of work platforms 21. As illustrated in FIG. 1, they are removably mounted on the top of the lifts by suitable means such as bolts 20. Since these platforms are intended to support men working at a raised position for an extended period of time, these platforms must include safety features such as uprights 21, safety rails 23 and override safety switches 22 which can override and cut off the lift means if the operator feels endangered by any operation of the lift means. In the use of the present invention for the purpose of installing elongated pipes in a ceiling structure, the platform 21 will normally serve two purposes. First, while mounted on the lifts they can be used to raise the workmen along with elements 31, 32 and 33 to secure these elements into place on the ceiling structure 30 prior to raising of the pipes 35. (During the process of raising the pipes 35 themselves, the platforms 21 will of course have been removed. The workmen can simply ride up on the top of the lift. The safety platforms are not as essential at this time since during this procedure the men will be in a raised position for only a very short period of time since little time is necessary to connect elements 33 and 36.) A second purpose of the platform 21, and a feature of the present invention, is that the platforms can include suitable means such as hooks 24 for hanging the platform 21 from the ceiling structure 30 to provide a safe and economical platform on which the workmen can stand while performing a time consuming welding operation at the abutment of the two pipes 35. This is contrasted with the prior art wherein the workmen would either have to stand on a ladder or on a platform which formed an integral part of a very expensive hydraulic lift device, thereby tying up that hydraulic lift at that location for an extended period of time.

For the most part, the details of the various control means, the support structure of the vehicle and the means for moving the vehicle are conventional. However, these features will be described below in order to better understand preferred arrangements thereof for use with the present invention.

In one embodiment of the present invention, the basic vehicle was formed by starting with a conventional pickup truck, stripping it down to the level of base 11 so that it included the original engine, transmission and chassis. It was modified to place essentially all of the controls in the cab 12 located to one side of the vehicle. This relocation of the cab was important to provide complete access in the forward and rearward directions so that an elongated object could extend forwardly and rearwardly of the vehicle.

One particular type of elongated object which has been handled most suitably with the present invention is elongated large diameter pipes for installation in a building structure for plumbing or the like. Because of their great weight, these pipes have generally been lifted in maximum lengths of 20'. However, with the advantage of using the present invention, applicant has found that pipes could be lifted in lengths of 40' to 50' (they are provided in random lengths from the pipe manufacturer) having a weight of approximately 1700 to 1800 pounds apiece. With the embodiment produced from the pickup truck, applicant was able to handle two such pipes, i.e. load two such pipes on the vehicle concurrently for the trip from the pipe stockpile to the location at which lifting was to take place. However, no limitation is implied with respect to the strength of the basic vehicle so that using a much stronger chassis design, it would be possible to carry many more pipes simultaneously, i.e. for a ten ton truck approximately one half dozen such pipes. While wheels are usually more economical and readily available, there is no reason why the ground engaging structure could not have the form of an endless track.

There are many features of the vehicle which are or may be provided for the purpose of enhancing its maneuverability. This is important for two reasons. First, after the vehicle has picked up pipes from the storage pile, it will have to move into a partially constructed building, maneuvering between columns, to arrive at the location at which the pipes are to be elevated. Further, it may be necessary to raise the pipes to a position very close to existing columns. this would require sufficient maneuverability to move the vehicle very close to those columns.

In the embodiment made from the pickup truck, it was provided only with front end steering. However, it might be preferable to provide independent front and rear steering, thereby allowing the vehicle to move virtually sideways (in a crab-like manner). Also, instead of using a conventional truck transmission, it might be preferable to use a transmission having only a single forward and a single reverse speed. This would enhance maneuvering the vehicle into tight places, whereas on the other hand the usual need for multiple forward speeds is not present since this vehicle would normally be used only off the road.

Another problem encountered when working in the environment of a building under construction is that the ground may still be muddy and hence difficult to negotiate. To staisfy this requirement, it may be desirable to provide the vehicle with an optional 4-wheel drive. Another difficulty is that the building may have been enclosed prior to raising of the pipes, thereby precluding the use of a conventional gasoline engine. To satisfy this requirement, the vehicle could be provided with a diesel engine or possibly an electrical engine.

The operator of the vehicle would sit in the cab 12 at which there would be a console providing controls for moving the vehicle, operating its transmission, steering the vehicle and operating the hydraulic controls. Specifically, hydraulic controls are provided for the lifts 17, either independently or simultaneously, for moving the saddles 19 sideways, and these of course would be independent controls; and for operating the four outriggers 15. (All four could be operated independently or at least the sets on each side of the vehicle would be operated independently). An advantageous optional feature of the present invention would be to provide electrical controls such as electrically operated solenoids for operating the various hydraulic controls. The reason for this is that the operator in the cab 12 is normally in visual and voice communication with workmen in the vicinity of the two lifts 17 during the various operating procedures. With electric controls, the operator, after having parked the vehicle at the proper location, could then get out of the cab and move to a remote position with the electrical controls in hand, connected to the cab through suitable means such as cables, to thereby enhance visual and verbal communication with the other workmen.

As explained above, a scissors lift is preferred because of its wide range of operation between a very compacted position and a substantially raised position. In one embodiment, the lift is approximately 3' to 4' in its lowered position but can be raised to a height of approximately 20' above the base 11. However, in less demanding situations, other types of lifts such as telescoping lifts or the like can be used. Also, while in the illustrated embodiment lifting power is provided through hydraulic pistons and cylinders, preferably arranged to operate vertically, power may be provided by other means such as electric motors or the like driving a sprocket wheel located at the base of each the scissors lift, turning the lowermost frame members, and this of course would cause all of the other frame members to move, thereby raising the lift.

Another advantageous feature would be to provide either auxiliary electrical power or a means for taking power off of the main engine drive to supply power for workmen on the platform 21 to assist them in their operations such as using power tools to install the needle beams 30, etc.

For greater stability, it may be preferable to locate the outriggers 15 at a greater distance off to the side of the vehicle. However, as noted above, this vehicle must have maneuverability, and for this purpose it should not extend laterally more than approximately 8'. Hence, it may be desirable to provide outriggers which are located on horizontal beams which are extendable outwardly or retractable inwardly toward the vehicle.

The operation of the vehicle as illustrated in FIGS. 1 through 4 will now be described with reference to FIGS. 1 and 5 through 11.

Firstly, before even dealing with the pipes, the vehicle could be used to install the supporting elements in the ceiling structure. A large supply of needle beams 30 and associated elements 31 and 32 would be carried on the vehicle and brought to the job site. Workmen in the platforms 21 will then load onto the platform a needle beam and the associated elements 32 and 33, be raised upwardly to secure these elements in place. Because the vehicle includes two such platforms, a second operator could be performing the same operations in the other platform 21.

Figure 5:
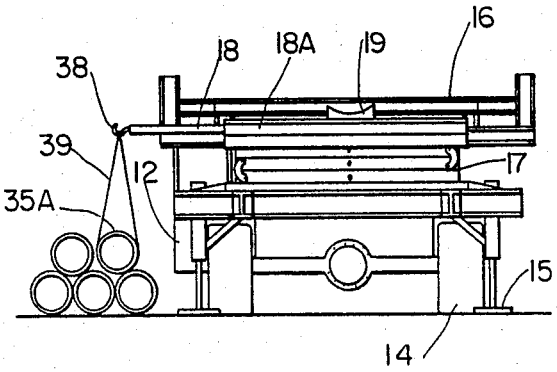
FIG. 5 is a rear elevational view of FIG. 1 illustrating a first operating position.
Figure 6:
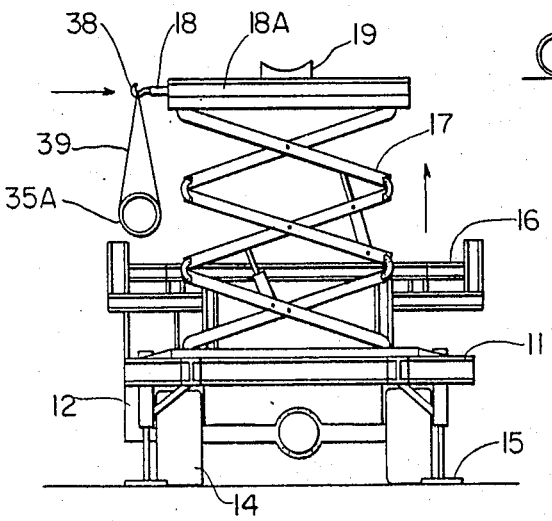
FIG. 6 is a rear elevational view similar to FIG. 5 showing a further operating position.

With the elements 31, 32 and 33 in place, the vehicle would then travel to the stockpile of pipes and park alongside the pile. Referring to FIG. 5, the hook rod 18 would be extended outwardly and a suitable cable 39 would be wrapped around a pipe and secured to the hook 38 at the end of rod 18. With pipe 35A held by two such cables 39, one connected to each of the rods 18, the two lifts would then be partially raised as shown in FIG. 6. Since the pipe 35A in the cables 39 is swinging, it can manually be swung up over the support stands 16 and the lift lowered to place the pipe 35A on the support stands 16. Since the rod 18 is extended and retracted only while not under load, it is not necessary to provide a power operated means for the same. However, if a power operated means were provided, it would facilitate its operation and also provide the additional advantage of simplifying the step shown in FIG. 6 of moving the pipe 35A over onto the stand 16. Specifically, the two rods 18 could simply be withdrawn hydraulically to relocate the pipe 35A over the stand 16. Although not illustrated in the figures, whether rod 18 was operated hydraulically or manually, it would be provided with a hook 38 at both ends, i.e. the tube 18A would be open at both ends, so that the vehicle could approach a pipe stockpile on either side.

After the pipe 35A has been placed onto the left hand side of the support stand 16 (as shown in FIG. 6) the rods 18 would be withdrawn and the lift would be lowered and that pipe would be rolled to the other side of stand 16, after which the procedure of FIGS. 5 and 6 would be repeated to load another pipe 35B onto the vehicle. A necessary limitation is that all of the pipes thus loaded onto the vehicle must be placed on support stand 16 transversely beyond the limits of the lifts 17 so that after loading the last pipe the lifts can be retracted below the upper level of stands 16. It is for this reason that bins 28 are advantageous, i.e. they provide additional storage space transversely out beyond the limits of lifts 17. If the vehicle were constructed to carry a larger number of large pipes such as six 10" pipes, it would of course be necessary to design the lift and the support stand such that they could carry these large pipes beyond the side limits of the lifts 17. The extendable outriggers might be particularly suitable with such an arrangement.

Figure 7:
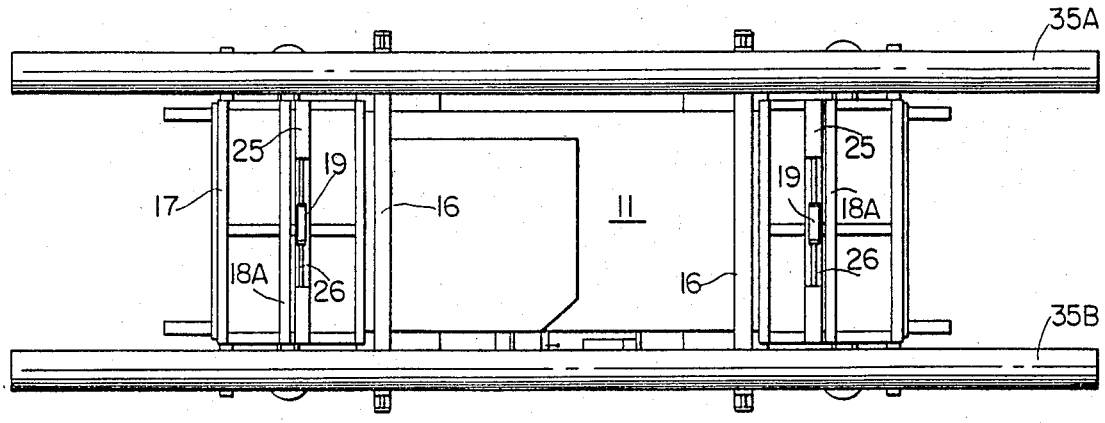
FIG. 7 is a plan view of the vehicle showing elongated objects mounted thereon and thus illustrating a further operating step beyond that shown in FIG. 6.
Figure 8:
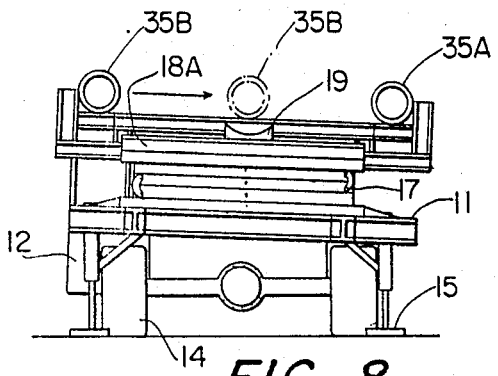
FIG. 8 is a rear elevational view similar to FIGS. 5 and 6 but showing a further step in the operation of the present invention.

With the pipes in place as shown in FIG. 7, they would be secured to the stands by suitable means such as chains, belts or the like to prevent movement during travel of the vehicle from the pipe stockpile to the lifting location.

Figure 9:
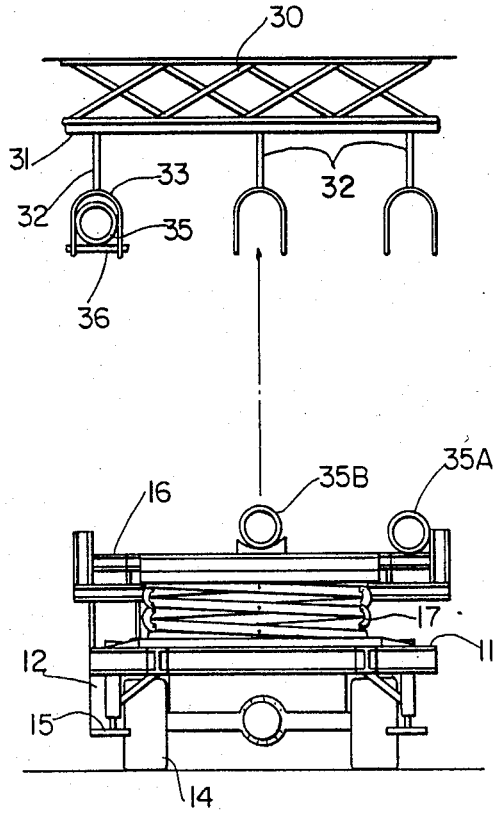
FIG. 9 is another rear elevational view similar to FIGS. 4–6 and 8 but showing a further step in the operation, together with a ceiling structure.
Figure 10:
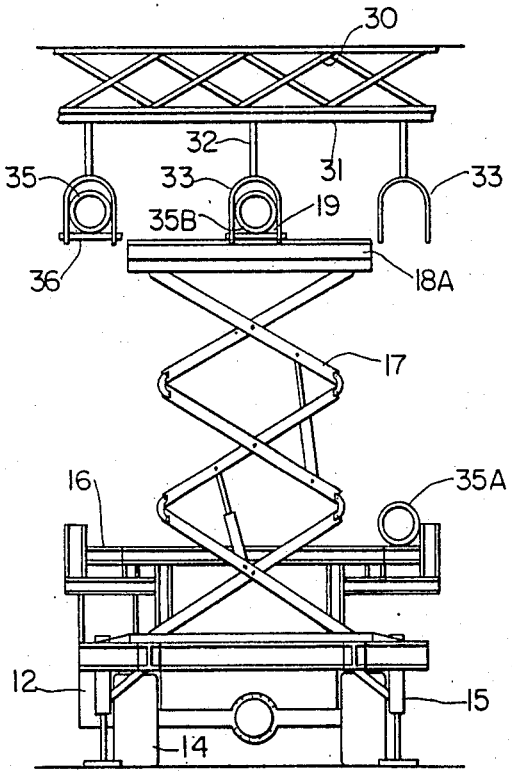
FIG. 10 is a view similar to FIG. 9 but showing the lifts in the raised position.

When the vehicle reaches the lifting location, the securing means are removed from one of the pipes and this pipe is moved into a central position over the saddles 19. Although the pipes might be very heavy, it is normally possible to roll them along the top of stands 16 to said central position. Alternatively, if desired or necessary, the outriggers 15 on one side can be raised slightly more than those on the opposite side to slightly tilt the vehicle and facilitate this step of rolling the pipe 35 to its central position. With the pipe in said central position, as shown in FIGS. 9 and 10, the lifts 17 are then raised, bringing the saddles 19 up onto the pipe and then raising the pipe up to its respective set of hanger portions 33. A workman will have ridden up with the pipe and he will then secure elements 33 and 36 together. This task is made relatively easy because there is normally a fair amount of play between the top of element 33 and the support bolt 36. This play can be used to raise the pipe 35 slightly beyond its final position, leaving play beneath the pipe so that the support bolt 36 can be attached completely free of the weight of the pipe, after which, when the lift 17 is lowered, the pipe will come down against its support bolt 36.

FIG. 12 illustrates an advantageous embodiment wherein the saddle 19 is replaced by a bar 40 having three separate saddles 43 through 45, the bar 40 provided with a piston 41 and a hydraulic cylinder 42. Assuming of course that the saddles are spaced apart the same distance as three of the hangers 33 in the ceiling structure, this embodiment of course provides the advantage of raising three elongated pipes simultaneously. Obviously the number of saddles can vary as can their spacing, dependent on the particular situation.

An important requirement when dealing with raising of pipes or other elongated objects is to achieve proper alignment. Often proper alignment is made difficult because the desired raised position is hard to reach, i.e. close to a set of columns. The present invention includes several features which enhance its ability to properly align the elongated object to be raised with the vertical plane of the raised position. Discussed above in this description were the features associated with maneuverability of the vehicle, which features facilitate aligning the vehicle and hence the elongated object into the proper vertical plane. In addition, the transverse adjustability of the saddles as provided by elements 25 and 26 enhance this ability. For example, referring to FIGS. 9 and 10, the hangers 33 into which the pipe 35 is being moved may have been just slightly to the left and it may have been impossible to move the vehicle any further to the left. In this case, both saddles 19 would have been moved to the left and the pipe then raised. Alternatively, it may be found that the vehicle is at a slight angle relative to the hanger elements 33 into which the pipe is to be raised. See for example FIG. 11 wherein the two elements 33 are shown one to the left and one to the right. In this case one saddle 19 could be moved to the left and the other to the right, as represented by the arrows in FIG. 11, after which the pipe would be raised into the elements 33.

FIG. 13 shows a modification which would permit a pipe 35 to be raised in a plane located very far to the side of the saddles 19, i.e. off to the side of the support stand 16 itself. For this purpose, a pair of extenders 47 having recesses 48 would be located on the ends of hook rods 18 or other rods provided for that purpose. In this case the pipes would have to be placed by other means directly into the recesses 48. While this does not permit the normal operation of the vehicle, as described above, it does permit a special form of operation which might be advantageous in certain circumstances. With the pipe 35 in place in the recesses 48, at least the lifts 17 could then be used to raise the pipe into place.

Although the vehicle of the present invention is particularly suitable for the handling and raising of elongated objects such as pipes, it is also readily adaptable for many other highly advantageous uses. Some of these additional applications of the present invention will be described below.

In many construction situations workmen must work at a certain location raised above the ground for an extended period of time. For example, there are locations where a large number of closely grouped parallel pipes, conduits and the like would intersect with another group running perpendicularly thereto. The interiors of these conduits must be interconnected with various connecting joints. A welder may have to spend a week or more just in that small area. Under previous practices, the workmen could either continuously reach the elevated location by a ladder or alternatively, an expensive lifting device with a platform on the top (such devices could cost approximately $21,000 apiece) could be stationarily located at that single place for the week or so while the workmen completed these welding operations.

With the features of the present invention, it is possible to utilize a simple large platform, for example 7'×20' to 40'. With the vehicle of the present invention, it is possible to take such a platform, and move it upwardly, and secure it to the ceiling structure, whereupon the workmen would have a simple but properly located platform covering this large work area. The platform could remain in place indefinitely, with the workmen using a simple ladder for access, while entirely eliminating the need to tie up a $21,000 piece of equipment for an extended period of time.

Figure 15:
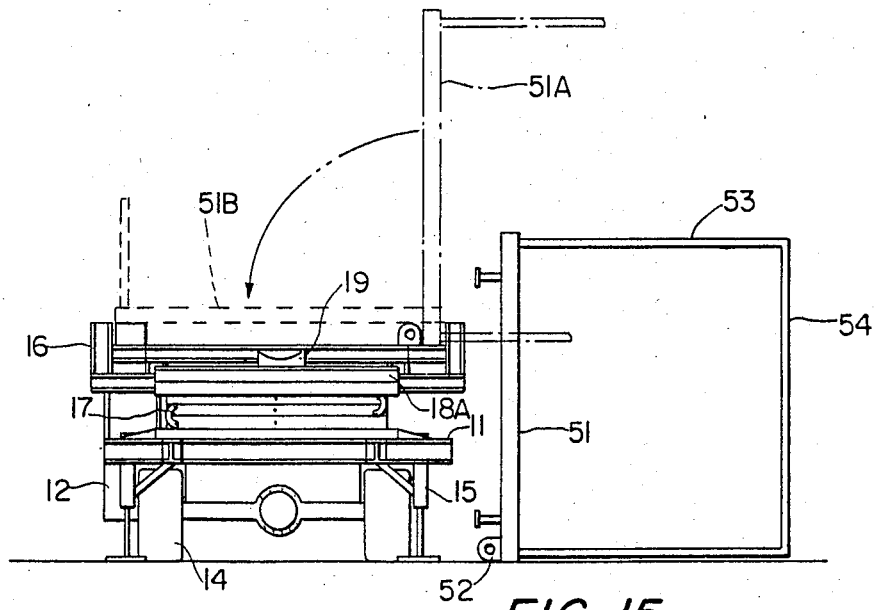
FIG. 15 is a rear view of a vehicle with the platform of FIG. 14 in different positions to illustrate the operation of the invention with respect to such platform.

This application of the present invention is illustrated in FIGS. 14 and 15. Such a platform, designated as 51, is shown on its side in FIG. 15 having uprights 53 and a safety rail 54. To accomodate this platform, the support stands 16 would be provided with a pair of hinges 50. The platform 51 would include a pair of similar hinges 52 on the bottoms thereof. With the platform laying on its side as shown in FIG. 15, the lifts 17, using its hook rods 18, would grab onto the platform 51 and lift it upwardly and place it onto support stand 16 as shown in dotted lines 51A in FIG. 15. With the hinges 52 aligned with stationary hinges 50, suitable pins would be passed through the hinges, after which the platform could be turned counter-clockwise as shown by the arrow in FIG. 15 until it assumes the dotted line position shown at 51B in FIG. 15. Suitable means would be provided to ease this downward movement of platform 51 such as cooperating surfaces on the upper right hand ends of lifts 17 against which the platform 51 could rest as it moved downwardly. The vehicle would then drive to the appropriate location and raise the two lifts 17, urging the platform 51 up into place, at which suitable means (not shown) would be used for connecting the platform to the ceiling structure 30.

Figure 16:
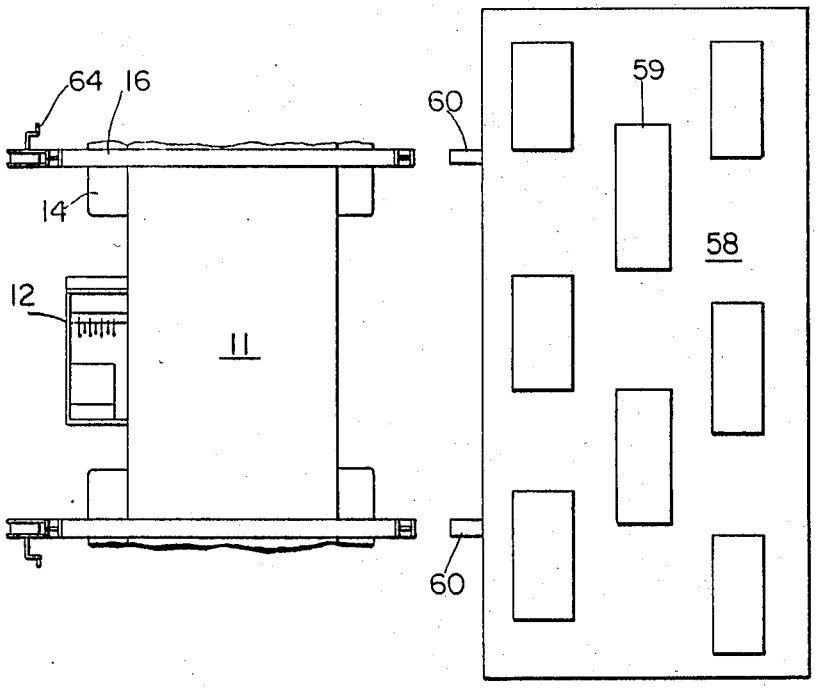
FIG. 16 is a plan view similar to FIG. 14, showing only the middle portion of a vehicle, together with a platform having work pieces thereon, to thereby illustrate an operation which can be carried out according to the present invention.
Figure 17:
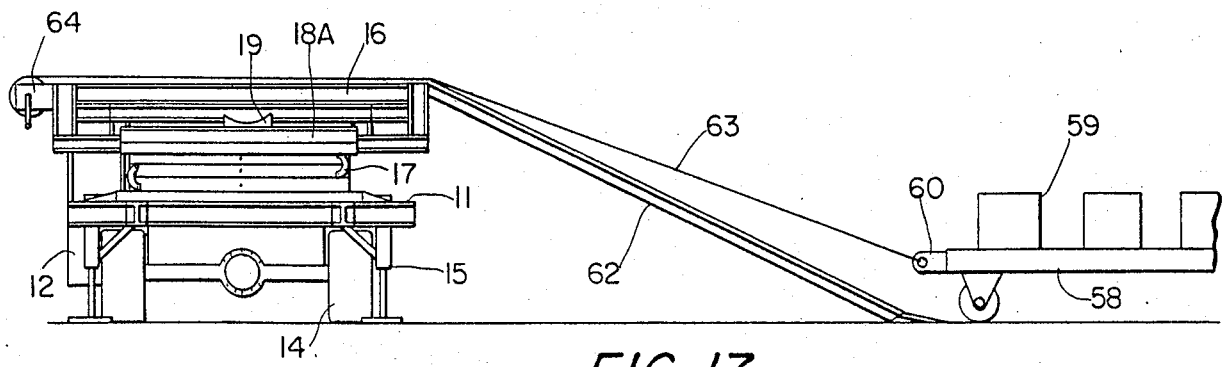
FIG. 17 is a rear elevational view similar to FIG. 15 but showing the elements of FIG. 16 and illustrating how the platform therein can be loaded onto the vehicle.

Another advantageous application of the present invention is shown in FIGS. 16 and 17. In the construction of a building or the like, all elements which are eventually raised up to the ceiling are of course arranged very precisely so as not to interfere with each other. For example, in addition to the pipes which have been described primarily hereinabove, a building installation would include conduits and the like for electrical installations, sheet metal ducting, installations for a water sprinkler system, etc. Under present practices, all such elements are brought to the job site, raised and installed piece by piece. However, the present invention would make possible a conceptually different approach to the installation of such elements. Realizing that each subcontractor assigned to one of the above noted tasks would have complete plans for their position by way of blue prints or the like, he could now take sections of approximately 7'×20' to 40' and place all of the elements necessary for that section onto a large platform having wheels. Indeed, the placing of these materials onto the large platform could be performed at a distant location and the platform then carried to the job site by a flatbed truck or the like. At the site, the platform could then be loaded onto the vehicle of the present invention and raised into place at ceiling height.

Referring to FIGS. 16 and 17, such a platform 58 is shown with materials 59 prearranged thereon. These materials 59 are shown only schematically but they could comprise sheet metal ducting, elements for a water sprinkler system, elements for an electrical installation, etc. As shown in FIG. 17, the support stands 16 would be modified to remove at least one of the uprights protruding above the horizontal bar of stands 16, a ramp 62 would be provided, and a suitable cable 63 and winch 64 could be provided for pulling the platform 58 up the ramp 62 and onto the stands 16. Alternatively, if the materials 59 could be secured tightly enough to the platform 58, the platform could be turned on its side and raised as shown in FIGS. 14 and 15.

Figure 19:
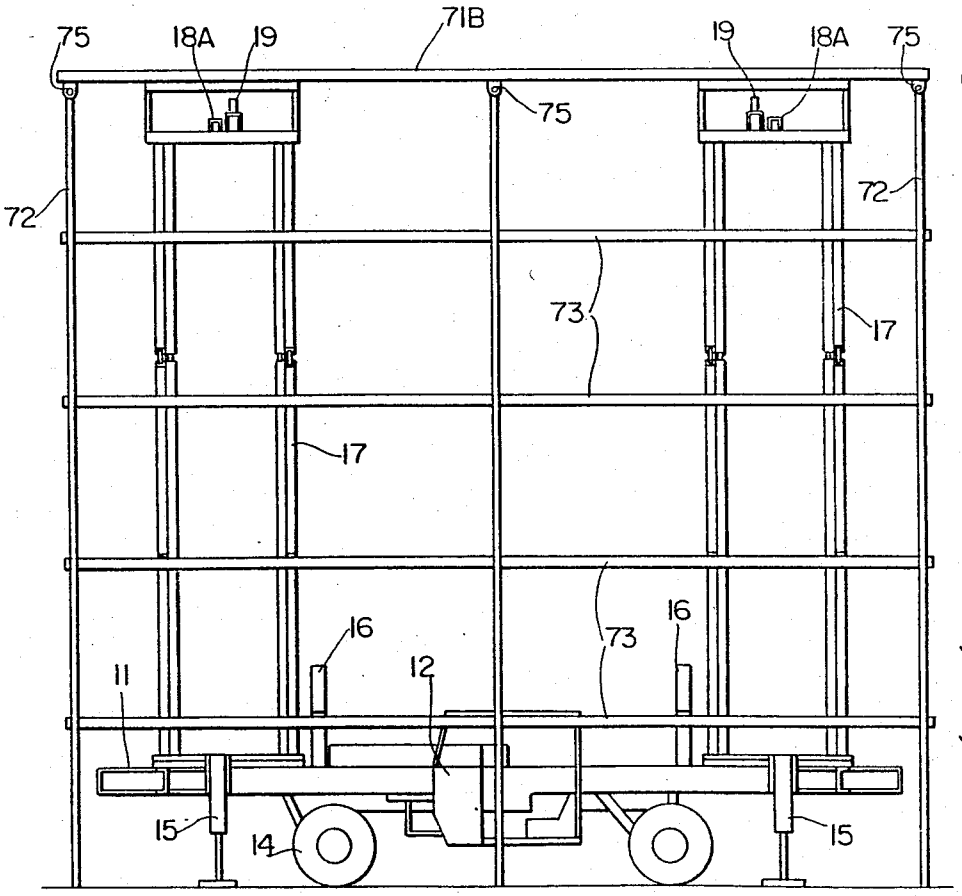
FIG. 19 is a side elevational view taken along line 19—19 of FIG. 18.
Figure 18:
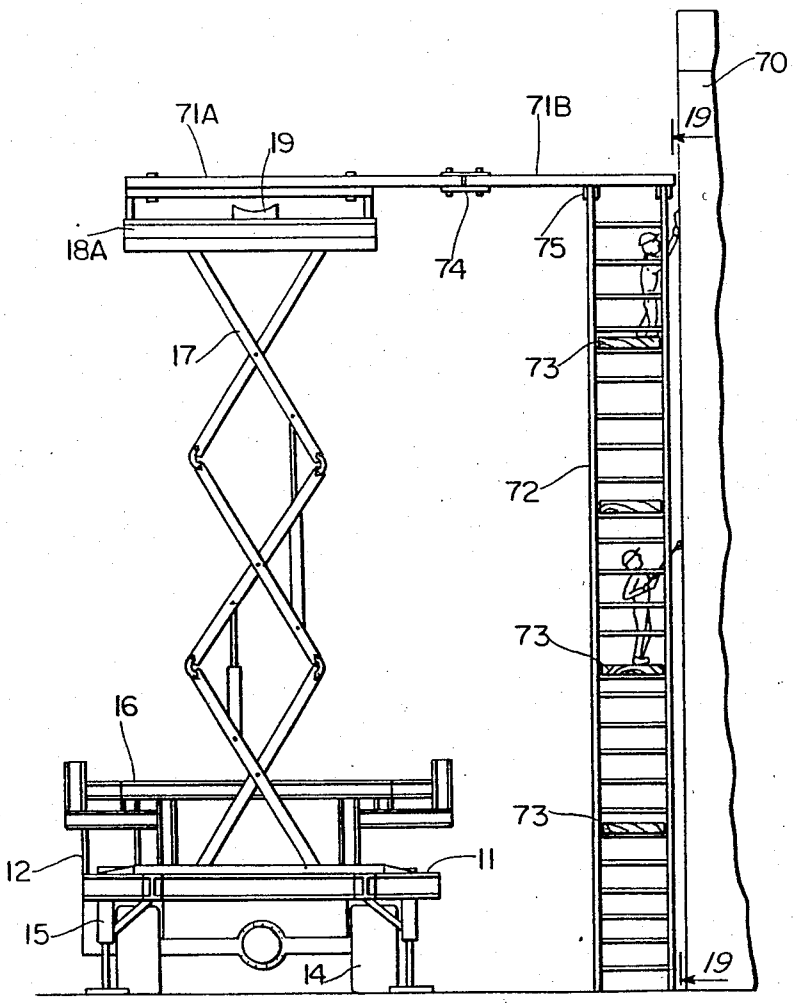
FIG. 18 is an end elevational view of the vehicle with a scaffolding attached thereto to illustrate a further operation which is possible with the present invention.

FIGS. 18 and 19 illustrate another advantageous application of the present invention. Specifically, it can provide a substantially improved scaffolding for working on the side of a building, as is the case with painters, glass installers, siding installers, etc. A first support portion 71A would be secured by bolts or the like to the top of lifts 17 and a further support portion 71B would be attached to the side thereof by suitable connecting means such as 74. The portions 71A and 71B constitute a scaffold support means. A ladder type scaffolding such as 72 could be connected to either end of the board 71B by suitable connecting means illustrated diagrammatically at 75. Boards 73 could then be placed at any desired position to permit workmen to work on the side of building 70. This has the advantage of extremely rapid installation and removal compared with a conventional scaffolding, and it permits the support surfaces, the boards, to be placed at a plurality of different locations so that different workmen can work simultaneously at different levels.

Although the invention has been described in considerable detail with respect to preferred embodiments thereof, it will be apparent that the invention is capable of numerous modifications and variations apparent to those skilled in the art, without departing from the spirit and scope of the invention, as defined in the claims.

I claim:

1. A load raising vehicle comprising, in combination:

a ground engaging and chassis structure, a base supported by the ground engaging and chassis structure to travel along the ground therewith, a support surface means stationarily mounted on the base and extending horizontally, transversely across the vehicle to support an elongated object extending longitudinally of the the vehicle, and a lifting means mounted on the base and being aligned, longitudinally with a portion of said support surface means, said lifting means being movable between a lowered position, at which the top of the lifting means is below the height of said support surface means and a raised position at which the top of the lifting means is substantially higher than said support surface means, power operated means for effecting vertical movement of the lifting means, wherein the lifting means can engage an elongated object supported by the support surface means from below and raise the object to a substantial height above the support surface means, said elongated object being a scaffold support means including a first support portion secured to the lifting means and positioned substantially over the vehicle and a second support portion connected to the first support portion extending transversely outwardly sideways from the vehicle and including a scaffold structure connected to the second support portion of the scaffold support means and extending therefrom downwardly substantially to the ground level engaged by the vehicle, whereby the scaffold is positioned adjacent a vertical surface of a structure while substantially free from load bearing support by said structure.

2. A load raising vehicle according to claim 1, said lifting means comprising a pair of longitudinally spaced apart lifts located adjacent said support means, taken in the longitudinal direction of the vehicle.

3. A load raising vehicle according to claim 2, said support surface means comprising a pair of support stands spaced apart longitudinally, one lift being adjacent each support stand on the side thereof toward its respective end of the vehicle.

4. A load raising vehicle according to claim 3, each of said lifts being a scissors lift.

* * * * *